United States Patent [19]

Calvert et al.

[11] 4,138,163

[45] Feb. 6, 1979

[54] BULK MATERIAL CONTAINERS

[75] Inventors: William L. Calvert, Knoxville, Tenn.; James R. Fisher, Fairfield, Conn.

[73] Assignee: Union Carbide Corporation, New York, N.Y.

[21] Appl. No.: 853,761

[22] Filed: Nov. 21, 1977

Related U.S. Application Data

[63] Continuation-in-part of Ser. No. 635,274, Nov. 26, 1975, abandoned, which is a continuation-in-part of Ser. No. 415,190, Nov. 12, 1973, abandoned, which is a continuation of Ser. No. 245,712, Apr. 20, 1972, abandoned.

[51] Int. Cl.[2] ..... B65G 53/40

[52] U.S. Cl. ..... 302/52; 222/610; 105/366 R; 220/1.5; 220/71; 214/1 N; 296/35 A

[58] Field of Search ..... 222/608-610, 222/193, 185, 181; 105/248, 366; 52/196, 197; 296/35 A; 214/1 N, 512; 302/52; 220/1.5, 4 R, 5 R, 71, 75

[56] References Cited

U.S. PATENT DOCUMENTS

| | | | |
|---|---|---|---|
| 2,622,771 | 12/1952 | Tulou | 220/1.5 |
| 3,047,189 | 7/1962 | Paul | 220/71 |

*Primary Examiner*—Allen N. Knowles
*Assistant Examiner*—H. Grant Skaggs
*Attorney, Agent, or Firm*—Gerald R. O'Brien, Jr.

[57] ABSTRACT

A container for use in the bulk handling of flowable particulate materials is disclosed comprising a closed, generally rectangular parallelpiped on upper container body portion, having side walls, end walls and a roof, and a lower base portion; conduits permitting the introduction and withdrawal of particulate materials to and from the container body; the lower base portion supporting a vertical flexure panel at each corner thereof, the vertical flexure panels supporting opposed pairs of longitudinal and transverse flexure panels between the tops thereof; exterior outer skin members bonded as side and end walls and roof of the container body portion to the curved flexure panels; a plurality of horizontal, non-intersecting internal end wall stiffeners bonded to each of the end walls, each terminating at opposite ends in a junction with one of the pair of vertical flexure panels; a plurality of vertical, non-intersecting internal side wall stiffeners bonded to each of the side walls, each terminated at opposite ends in a junction with one of the longitudinal flexure panels and the lower base portion; and a plurality of transverse, internal, non-intersecting roof stiffeners bonded to the roof, and each terminated at opposite ends in a junction with one of the pair of longitudinal hinge panels; whereby the side walls, end walls and roof may deflect independently of each other to provide overall container flexural capability while avoiding areas of high stress concentration.

9 Claims, 5 Drawing Figures

Fig.1
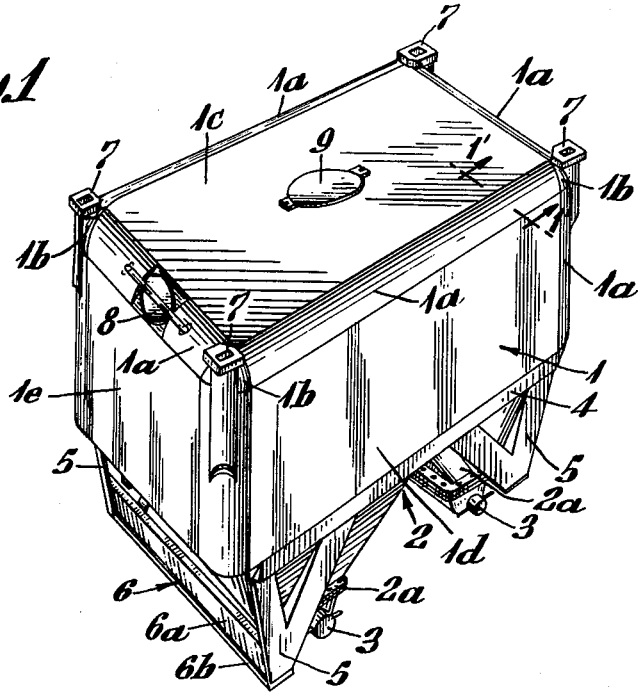
Fig.2
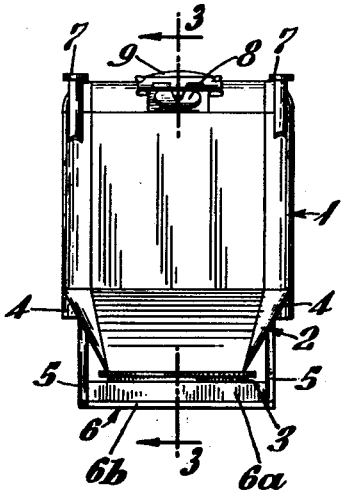
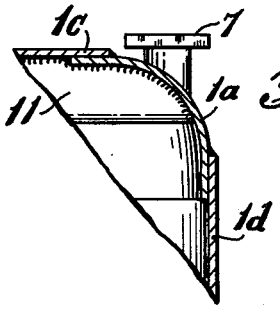
Fig.1'
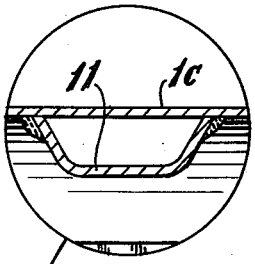
Fig.3'
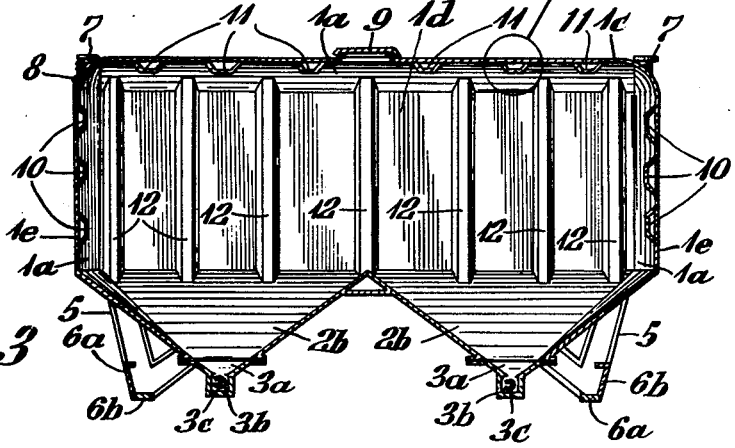
Fig.3

BULK MATERIAL CONTAINERS

This is a continuation-in-part of our copending application Ser. No. 635,274 filed Nov. 26, 1975 and entitled "Bulk Material Containers," which is, in turn, a continuation-in-part of Ser. No. 415,190 filed Nov. 12, 1973 and entitled "Bulk Transport Containers" and, in turn, a continuation of Ser. No. 245,712 filed Apr. 20, 1972 and entitled "Bulk Transport Containers," all of the three prior applications now being abandoned.

The present invention relates to bulk material containers and, more particularly, to bulk material containers for flowable particulate materials, which containers are suitable for both rail and highway transport and are demountable for transfer from one vehicle to another or for storage.

Certain bulk material containers are known which are mountable on and demountable from a railcar or highway vehicle. Such containers, generally, must be tilted to achieve total discharge; and, further, they are filled in a horizontal position through top hatches, a method not conductive to achieving maximum fullness. Some bulk containers are made integral with their respective vehicles (e.g. hopper trucks and hopper cars) and are, therefore, unsuitable for intermodal transport and uneconomical for storage.

Other demountable bulk containers are known which incorporate such features as convergent lower portions (hopper bottoms) to facilitate total gravity discharge and/or eccentrically located upper filling hatches combined with tilting provisions to facilitate maximum fill. Such containers are generally provided with one or more means of engagement for lifting (e.g. lift truck fork pockets, eyebolts or the like); but they are characteristically provided with but a single support means whereby they may rest on a railcar deck, truck bed or storage pad. This latter fact implies that the overall height of such a container above a railcar deck will be the same as its overall height above a truck bed; and it further implies that such a container, if built to the maximum allowable height for railroad service, would far exceed allowable limits for highway use; and, conversely, such a container dimensioned for highway use could not fully utilize the volume capacity of a railcar. It is to be noted, therefore, that known bulk containers, characterized by a single mode of bottom support, are not adaptable to optimal utilization of both rail and truck transport of material whose bulk density is such that volume rather than weight is the critical constraint.

It is an object of the present invention to provide a bulk material container having roof and walls which, when subjected to internal or external loadings, may deflect independently of each other while avoiding areas of high stress concentration.

It is another object of the invention to provide a bulk material container which is readily mountable to and demountable from both a truck trailer chassis and a railcar bed.

It is still another object of the invention to provide a container which can more completely utilize the capacities of, and can be transported by, both trucks and railcars.

It is a further object of the invention to provide a container which, without resort to exotic and costly materials and methods of construction, will exhibit superior durability and rupture resistance.

Further objects and advantages of the invention will be apparent from the following description and appended drawings.

In the drawings:

FIG. 1 is a perspective view of a container embodying the invention;

FIG. 1' is an exploded partial sectional view taken along the line 1' — 1' of FIG. 1;

FIG. 2 is an end elevation view of such container;

FIG. 3 is a longitudinal sectional view of the container taken along line 3 — 3 of FIG. 2;

FIG. 3' is an exploded view of a portion of the longitudinal sectional view of the container indicated by the connected circle in FIG. 3.

Figure 4:
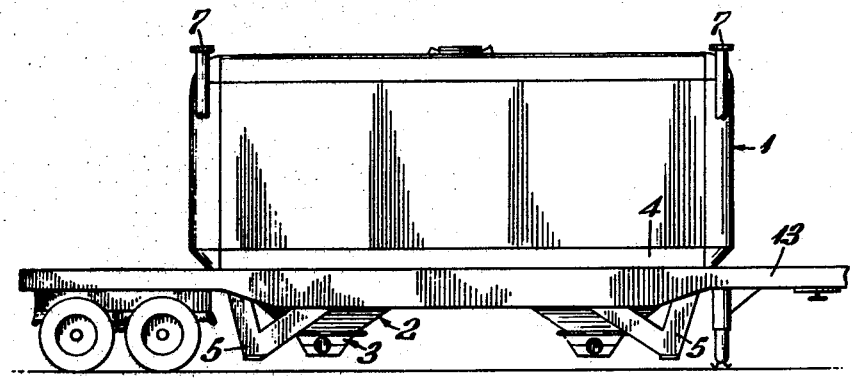
Figure 5:
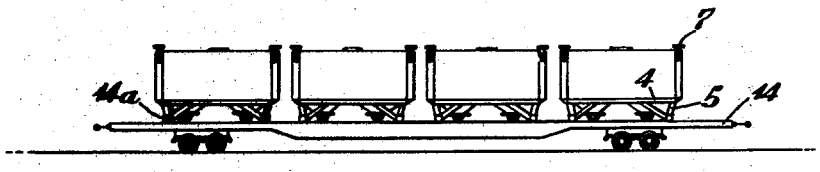

FIG. 4 is a side elevation graphic depiction of the container mounted on a truck trailer chassis; and FIG. 5 is a side elevation graphic depiction of four containers mounted on a railcar bed.

In accordance with the present invention, container for use in the bulk handling of flowable particulate materials is provided comprising a closed, generally rectangular parallelepipedon upper container body portion, having side walls, end walls and a roof, and a lower base portion; means permitting the introduction and withdrawal of said particulate materials to and from said container body; said lower base portion supporting a vertical flexure panel at each corner thereof, said vertical flexure panels supporting opposed pairs of longitudinal and transverse flexure panels between the tops thereof; flush exterior outer skin members bonded as side and end walls and roof of said container body portion to said curved flexure panels; a plurality of horizontal, non-intersecting internal end wall stiffener means bonded to each of said end walls, each terminating at opposite ends in a junction with one of said pair of vertical flexure panels; a plurality of vertical, non-intersecting internal side wall stiffener means bonded to each of said side walls, each terminated at opposite ends in a junction with one of said longitudinal flexure panels and said lower base portion; and a plurality of transverse, internal, non-intersecting roof stiffener means bonded to said roof, and each terminated at opposite ends in a junction with one of said pair of longitudinal hinge panels; whereby said side walls, end walls and roof may deflect independently of each other to provide overall container flexural capability while avoiding areas of high stress concentration.

Referring specifically to the embodiment of the drawings, there is illustrated a container, constructed preferably of aluminum, having an upper container body portion 1 and a lower base portion 2.

The upper portion preferably has the shape of a rectangular parallelepipedon with eight successively-joined cylindrically curved edge panels 1*a* and partially spherically shaped corner section panels 1*b* supporting one roof 1*c*, two sidewalls 1*d* and two endwalls 1*e*. While it is to be understood that the preferred embodiment employs the partially spherical shaped corner section panels 1*b* as intermediate members between the top junctions of the vertical, horizontal and end flexure panels at each of the four corners of the roof of the container of the invention, one can merely directly join the three flexure panels at their corner points of intersection without such curved corner panel. This elimination of the indirect junction through the curved corner panel will present a somewhat more difficult junction problem and provide a container not having the desired spherical roof corners.

The lower base portion 2 preferably comprises a pair of inverted truncated pyramidal structures, said structures, hereinafter referred to as "hopper-bottoms," being joined together along one upper edge to form a single unit, and said unit being joined to and depending from the lower periphery of said upper base portion 1. The hopper-bottoms 2*b* terminate in two rectangular flanged openings 2*a*, to each of which is secured a discharge valve assembly 3. Along the lower edge of each sidewall 1*d*, and extending approximately the length thereof, is a horizontal siderail 4 having an L-shaped cross-section with its vertical leg lying in the downward extension of the plane of the sidewall 1*d* and its horizontal leg turned inward and joined to the walls of the hopper-bottoms 2. The horizontal siderails 4 constitute a first support means for the container. From the junction of the siderail 4 with the hopper-bottom 2, near each end of the container and on each side thereof, there extends downward a support leg structure 5 whose lower extremity terminates at a horizontal plane just slightly below the lowest extremities of the discharge valve assemblies 3. The pair of support leg structures 5 at each end of the container is joined together by a transverse structure 6 comprising a foot-plate 6*a* and a lateral brace 6*b*. The complete system of structures, comprising support legs 5, footplates 6*a* and transverse braces 6*b*, constitutes a second support means for the container. Lift fittings 7, to be more fully described hereinafter, are designed for compatibility with ISO (International Standards Organization) container standards and are located at the four upper corners of the container. A filling hatch assembly 8, comprises a flat plate with a curbed oval opening having a hinged, gasketted cover and means for securing said cover in the closed position. The hatch assembly is centrally located in the curved edge panel 1*a* at one extreme end of the roof 1*c*. An alternate filling hatch assembly 9 is centrally located in the roof 1*c* and comprises a circular opening having a hinged, gasketted cover with means for securing said cover in the closed position.

Referring now to FIG. 2, particular attention is called to the first support means 4 and the second support means 5 and 6 and to the spatial relationship between the two. It is significant that the width of the second support means 5 and 6, designed to support the container on a railcar, is less than the width of the first support means 4 by an amount which permits the second support means to drop through the opening in a truck trailer chassis which is constrained by the same overall width limitations as the container itself. In this way, the container may be supported by its first support means and thus present a minimum height profile when being trucked over the highway. It is this provision of dual support means which makes it possible to optimize the overall height of the container within rail transport constraints while, at the same time, optimizing the height of the upper portion of the container within highway transport constraints.

Referring to the sectional views of FIGS. 1', 3 and 3', the interior construction of the container is shown including endwall stiffeners 10, roof stiffeners 11 and sidewall stiffeners 12. All stiffeners and channel-shaped members with the channel flanges divergent, the edges of said flanges being bonded to the inner surface of the container shell by welding. Endwall stiffeners 10 are preferably horizontally disposed and are joined (as by welding) at their intersections with the curved vertical flexure hinge members or panels 1*a* disposed between the endwalls 1*e* and sidewalls 1*d*. The roof stiffeners 11 are transversely disposed and are joined (as by welding) at both ends at their intersections with the curved longitudinal flexure hinge members or panels 1*a* disposed between the roof 1*c* and the sidewalls 1*d*. The sidewall stiffeners 12 are vertically disposed, joined (as by welding) at their upper ends at their intersections with curved longitudinal flexure-hinge members or panels 1*a* disposed between the roof 1*c* and sidewalls 1*d*, and joined (as by welding) at their lower ends at their intersections with the sloping sidewalls 2*b* of the hopper-bottoms 2. It is a significant feature of the container construction that these rigid stiffeners 10, 11 and 12 are so disposed and spaced that at no points do they connect to each other to form a rigid frame for the container. This arrangement of stiffeners, together with the omission of rigid corner posts and perimeter framing members, imparts two highly beneficial qualities to the container: first, wall and roof flexure hinge members or panels, when subjected to internal or external loadings, may deflect independently of each other, the curved panels 1*a* acting in the manner of flexure hinges, whereby many areas of high stress concentration are avoided; and, second, given a total weight allowance for the container, the minimal framing leaves a larger proportion of the total weight allowance available for the skin of the container, whereby said skin may be thicker and more rupture resistant than is possible with a conventional, rigidly framed container of comparable weight.

Thus, the container of the invention provides adequate wall bracing with a minimum in sacrifice of usable container volume. Smooth or flush exterior walls and top are also provided for the container which preferably comprises an outer skin or shell having rounded edges and spherical corners.

The wall bulging forces in the container of the invention are taken by a relatively thick skin with widely spaced stiffening ribs, rather than a thin skin having closely spaced stiffening ribs.

The container of the present invention eliminates the need for heavy corner posts and case end fittings.

There is shown a FIG. 3 a discharge valve assembly 3, one of which is associated by bolted and gasketted flange connection to the lower extremity of each hopper-bottom 2. The valve assembly 3 comprises an upper chamber 3*a* bounded by two opposed vertical walls and two opposed sloping walls whose lower edges define a transverse slot, said slot communicating with a lower chamber 3*b* in which is located a slotted tubular element 3*c*, said tubular element extending the full length of the lower chamber 3*b* and penetrating the end walls thereof through close-fitting apertures, and said tubular element 3*c* being rotatable about its axis to bring its slot into greater or lesser alignment with the slot in the bottom of the upper chamber 3*a*, whereby the flow of container contents from the hopper-bottom into the tubular element may be regulated. Also shown, in the opened position, are end caps 3*d* which may be placed over the extended ends of the tubular elements 3*c* to prevent contamination. Not shown is a pneumatic conveying system which connects to either end of the tubular element 3*c* for evacuation of the container.

The pneumatic conveying system may be either of the positive pressure type, and may be connected to both the means for introducing and withdrawing the particulate material, or it may be of the vacuum pressure type (such as an air conveyor or airveying system)

and may be connected to the means for withdrawing the particulate material.

Referring to FIG. 1, there is shown the four lift fittings 7 which constitute the lifting means for the container. Each preferably comprises a vertical tubular element having some of its lower portion cut away to leave a semi-cylindrical shape and some of its upper portion cut away to approximately fit the preferable spherical contour of the container achieved by the employment of corner panels 1*b*, whereby it may be fitted to and welded to the upper corner of the container, specifically to cylindrically curved panel 1*a* and spherically curved panel 1*b*; and horizontal top plate having therein an elongated aperture with chamferred edges. During the lifting operation, an inverted T-shaped fixture (not shown) is inserted into the aperture, rotated 90° to prevent its extraction and then elevated to lift the container, this operation being caused to take place simultaneously at all four corners of the container by means of a spreader frame and related conventional equipment (not shown). It is to be noted that the lift fittings 7 are completely external to the container and that their tubular member may be extended downward as far as necessary to develop the length of weld lines required to bear the weight of the container.

Referring to FIG. 4, there is shown the container of the invention mounted on a truck trailer 13 and, more particularly, there is illustrated the manner in which the container is supported by its first support means 4, while the second support means 5, hopper-bottoms 2 and discharge valve assemblies 3 protrude through appropriate openings in the chassis. The container may be mounted to and demounted from the trailer 13 by the lifting means 7 in the manner previously described.

Referring to FIG. 5, there is shown a railroad car 14 on which are mounted four containers according to the invention. It is to be noted that, for this mode of transport, the container is supported by its second support means 5, the railcar 14 being equipped with deck-mounted fixtures 14*a* designed to accept and secure the lower extremities of said support means 5. The container is mounted to and demounted from the railcar 14 by the lifting means 7 in the manner previously described.

It is to be noted that the container of this invention, together with the compatible rail and highway vehicles and other auxiliary equipment as described therein, constitutes a thoroughly unique intermodal bulk transport system. Specifically, this system makes possible the packaging of a most economically attractive large quantity of a bulk commodity in a container; movement by the most economical combination of rail and highway transport to a destination, with no intervening transfer of the commodity from one container to another; and subsequent discharge of the commodity from the container by a conventional pneumatic system without need to tilt the container. A transport system having capabilities thus described is heretofore not available and is, in fact, dependent upon several of the novel features of the container of this invention for its implementation.

While the container specifically described herein respresents a preferred embodiment of all of the aspects of the present invention, it is not intended that this specification shall be construed to exclude from the scope of the invention any of the several and obvious variations or combinations of the novel aspects described. For example, the container may be constructed of material other than aluminum, such as steel or fiberglass; and it may employ any appropriate combination of joining or bonding techniques, such as welding, riveting or adhesives.

What is claimed is:

1. A container for use in the bulk handling of flowable particulate materials comprising a closed, generally rectangular parallelepipedon upper container body portion, having side walls, end walls and a roof, and a lower base portion; means permitting the introduction and withdrawal of said particulate materials to and from said container body; said lower base portion supporting a vertical flexure panel at each corner thereof, said vertical flexure panels supporting opposed pairs of longitudinal and transverse flexure panels between the tops thereof; exterior outer skin members bonded as the side and end walls and roof of said container body portion to said flexure panels; a plurality of horizontal non-intersecting internal end wall stiffener means bonded to each of said end walls, each terminating at opposite ends in a junction with one of said pair of vertical flexure panels; a plurality of vertical, non-intersecting internal side wall stiffener means bonded to each of said side walls, each terminated at opposite ends in a junction with one of said longitudinal flexure panels and said lower base portion; and a plurality of transverse, internal, non-intersecting roof stiffener means bonded to said roof, and each terminated at opposite ends in a junction with one of said pair of longitudinal flexure panels; whereby said side walls, end walls and roof may deflect independently of each other to provide overall container flexural capability while avoiding areas of high stress concentration.

2. The container in accordance with claim 1, also having at least one convergent hopper-bottom with operable bottom closure means comprising said means permitting withdrawing of particulate materials.

3. The container in accordance with claim 2, having two convergent hopper-bottoms.

4. The container in accordance with claim 3, wherein said hopper-bottoms have the shape of inverted truncated pyramids.

5. The container in accordance with claim 4, wherein the upper portion of said container body has rounded corners and edges.

6. The container in accordance with claim 3, wherein said means permitting withdrawal of particulate materials including a pneumatic discharge valve adapted to cooperate with an air conveyor system for evacuation of particulate material from said container.

7. The container in accordance with claim 1, having at least one introducing means positioned near an upper edge of said container body, whereby said container may be substantially completely filled when said container is oriented in a tilted position to place said introducing means in an uppermost position.

8. A container in accordance with claim 1, suitable for use in the intermodal bulk handling of flowable particulate materials also comprising: means for mounting said container on and demounting it from a transport vehicle; said upper container body having a larger horizontal width than the lower base portion at and below a point thereof forming a first support means for supporting said container horizontally in an open highway vehicle bed having a width approximately equal to the width of the upper container body and providing support at said support means; the lower base of said container body having second support means extending below the upper container portion of said body and adapted for supporting said container horizontally on a flat bed.

9. A container in accordance with claim 1, suitable for use in the intermodal bulk handling of flowable particulate material also comprising: means for mounting said container and demounting it from a transport vehicle; said upper container body having a larger horizontal width than the lower base at and below a point thereof forming a first support means for supporting said container horizontally in an open highway vehicle bed having a width approximately equal to the width of the upper container body and providing support at said support means so that, as positioned in said open vehicle bed, a substantial portion of said container hangs through and extends below said vehicle bed thereby lowering the position of the center of gravity of said container as to said vehicle bed; the lower base of said container body having second support means extending below the container portion of said body to support said container horizontally on a flat bed.

* * * * *